US005473781A

United States Patent [19]

Greenberg

[11] Patent Number: 5,473,781

[45] Date of Patent: Dec. 12, 1995

[54] SOCK HAVING A FOOT ARCH SUPPORT

[76] Inventor: Bert Greenberg, 2030 S. Ocean Dr., Hallandale, Fla. 33009

[21] Appl. No.: 334,250

[22] Filed: Nov. 4, 1994

[51] Int. Cl.[6] ..... A41B 11/00

[52] U.S. Cl. ..... 2/239; 602/66

[58] Field of Search ..... 2/239, 240, 241, 2/409; 602/66, 23, 28, 62; 66/178 R, 182, 185, 186, 178 A; 36/91, 145

[56] References Cited

U.S. PATENT DOCUMENTS

| | | | |
|---|---|---|---|
| 858,006 | 6/1907 | Lum | 2/239 |
| 1,501,349 | 7/1924 | Jung, Jr. | 602/66 |
| 1,577,203 | 3/1926 | Crainer | 602/66 |
| 1,702,661 | 2/1929 | Moran | 2/239 |
| 2,219,235 | 10/1940 | Morton | 2/239 |
| 2,515,903 | 7/1950 | Sjoquist | 602/66 |
| 2,708,930 | 5/1955 | Lowman | 602/66 |
| 2,790,975 | 5/1957 | McCormick | 602/66 |

FOREIGN PATENT DOCUMENTS

| | | | |
|---|---|---|---|
| 305373 | 2/1929 | United Kingdom | 2/239 |
| 485313 | 5/1938 | United Kingdom | 602/66 |
| 562926 | 7/1944 | United Kingdom | 2/239 |

*Primary Examiner*—C. D. Crowder
*Assistant Examiner*—Amy B. Vanatta
*Attorney, Agent, or Firm*—McAulay Fisher Nissen Goldberg & Kiel

[57] ABSTRACT

A sock having an elastic band is disclosed in which the band encircles an intermediate zone of the sock between the heel zone and toe zone. The band has a first edge near the heel zone and a second edge near the toe zone. The perimeter of the first edge of the band is greater than the perimeter of the second edge thereof to provide an inward taper for the band from the first edge to the second edge. The first edge of the band is attached to the intermediate zone of the sock and the second edge thereof is unattached. Further, the perimeter of the second edge of the band is substantially less than the perimeter of the intermediate zone of the sock. The arrangement is such that insertion of a wearer's foot in the sock will cause the elastic band to expand and provide support to the arch of the foot.

18 Claims, 2 Drawing Sheets

SOCK HAVING A FOOT ARCH SUPPORT

BACKGROUND OF THE INVENTION

I. Field of the Invention

This invention relates in general to a sock having a foot arch support and, in particular, to a sock in which insertion of a wearer's foot therein will cause an elastic band secured to the sock to expand and provide support to the arch of the foot.

II. Description of the Prior Art

Heretofore, it is known to wrap an elastic band or bandage around portions of the wearer's body, such as the wrist or knee or ankle, which have suffered injury. Wrapping the band around the injured body portion restricts movement of the ligaments and tendons to reduce swelling and pain.

In those instance where the injury is to the arch or the upper surface of the foot, the bandage is wrapped around that portion of the foot whereupon an outer covering is worn, such as a sock. However, in many cases, such as the elderly where movement may be difficult, and for injured persons where the injury prevents the wearer from bending forward to wrap the bandage around the foot, it becomes necessary for someone to assist in wrapping the bandage in place. The thickness of the wrapped bandage also may make it difficult, if not impossible, to wear a sock over the bandage, much less a shoe over the sock.

In still other applications of use not involving instances of injury, a person may prefer to have greater arch support when engaged in an athletic activity. This may be achieved by wrapping a separate elastic bandage around the foot. Here, too, wrapping of the bandage may prove uncomfortable, particularly if it is wrapped too tightly around the foot. In such instances, there is little "play" or expansion of the bandage which may restrict circulation. And yet, wrapping the bandage too loosely will result in providing little or inadequate arch support.

The present invention serves to reduce the problems associated with wrapping such bandages around the wearer's foot by having the elastic band connected directly to the sock which, upon insertion of the wearer's foot into the sock, will cause the band to expand to provide support to the arch of the foot in the manner hereinafter described.

SUMMARY OF THE INVENTION

The sock arch support of the present invention includes a sock having a heel zone, a toe zone, and an intermediate zone between the heel zone and toe zone. The intermediate zone has an upper surface, a lower surface, an outer perimeter, and an inner perimeter.

An elastic band is provided which encircles the intermediate zone of the sock. The band has a first edge near the heel zone and a second edge near the toe zone. The perimeter of the first edge of the band is greater than the perimeter of the second edge thereof to provide an inward taper for the band from the first edge to the second edge.

The first edge of the band is attached to the intermediate zone of the sock and the second edge thereof is unattached to the sock. Further, the perimeter of the second edge of the band is substantially less than the perimeter of the intermediate zone of the sock. Still further, the taper of the elastic band is at an angle sufficient to cause the intermediate zone of the sock to be compressed along most of the length of the band from the first edge to the second edge. The arrangement is such that insertion of a wearer's foot in the sock will cause the elastic band to expand and provide support to the arch of the foot.

In one embodiment, the first edge of the band is sewn to the sock along an outer perimeter of the intermediate zone of the sock. In another embodiment, the first edge of the band is sewn to the sock along an inner perimeter of the intermediate zone. In either of these embodiments, the invention further provides that, if desired, the band may be further attached to the lower surface of the intermediate zone of the sock along at least one line extending between the first edge and second edge of the band.

BRIEF DESCRIPTION OF THE DRAWINGS

For a more complete understanding of the invention and the various features and advantages thereof, reference is made to the following detailed description taken in conjunction with the accompanying drawings, in which.

DESCRIPTION OF THE PREFERRED EMBODIMENTS

Figure 1:
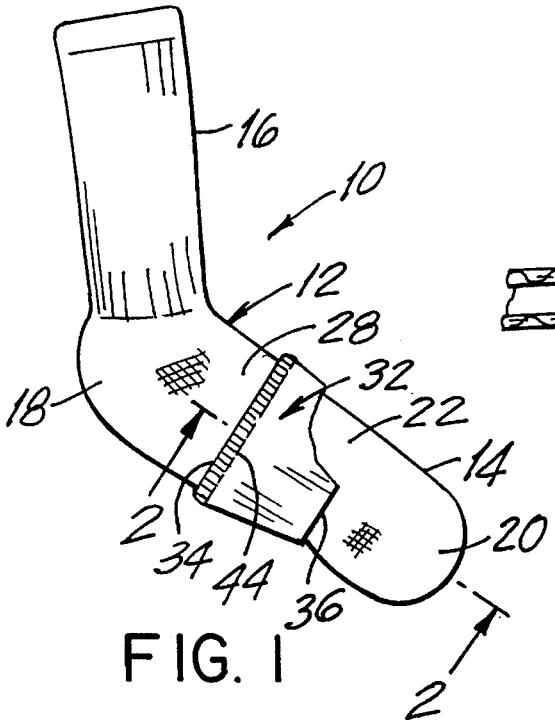
FIG. 1 is a side elevational view, with a portion broken away, of the combined sock with elastic band constructed in accordance with the present invention.
Figure 2:
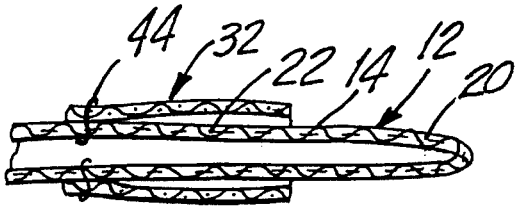
FIG. 2 is a sectional view taken along line 2—2 of FIG. 1.

Referring to the drawings, and particularly to FIG. 1, numeral 10 represents a combined sock with elastic band constructed in accordance with the present invention. The sock, itself, is represented by number 12 and includes a foot portion 14 and a leg portion 16. Sock 12 is intended to be a woven sweat sock as commonly worn when performing an athletic activity. However, the sock can be otherwise constructed and used for other purposes not associated with sports.

Figure 3:
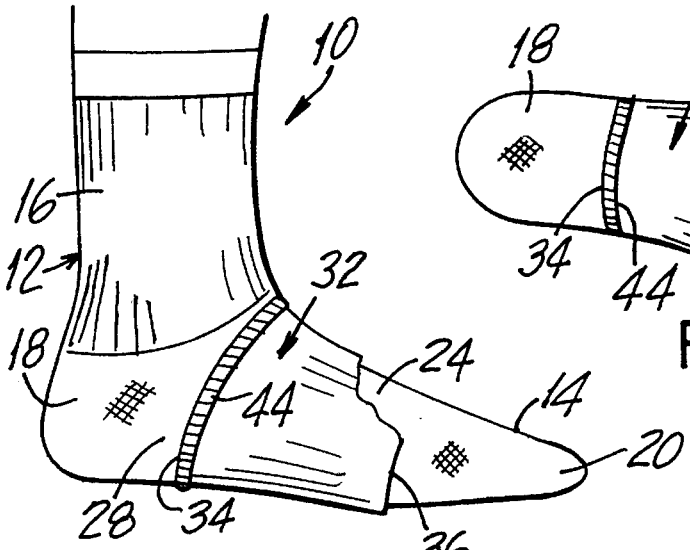
FIG. 3 is a view similar to FIG. 1 with the wearer's foot inserted into the sock causing the elastic band to expand and provide support to the arch of the foot.
Figure 4:
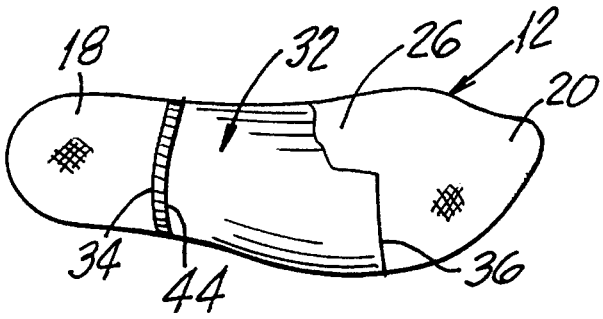
FIG. 4 is a bottom plan view of the sock shown in FIG. 3 with a portion of the band broken away.

Foot portion 14 has a heel zone 18, a toe zone 20, and an intermediate zone 22 between heel zone 18 and toe zone 20. Intermediate zone 22 has an upper surface 24 as shown in FIG. 3, a lower surface 26 as shown in FIG. 4, an outer perimeter represented generally by numeral 28 in FIGS. 1 and 3, and an inner perimeter represented generally by numeral 30 in FIG. 6.

An elastic band, represented generally by numeral 32, is secured to the intermediate zone 22 of sock 12. Band 32 is flexible and is made of woven or knitted fabric, such as nylon or other synthetic yarn, also having elastic yarn.

Figure 9:
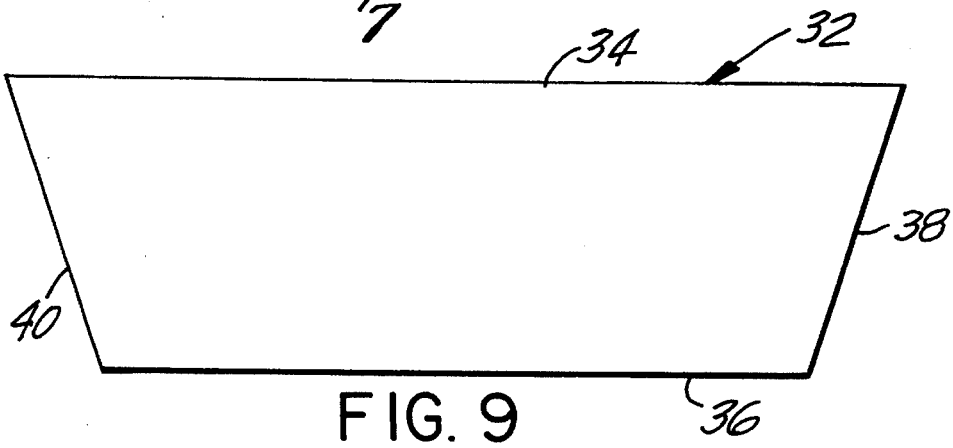
FIG. 9 is a top plan view of the elastic band, by itself, constructed in accordance with the present invention.
Figure 10:
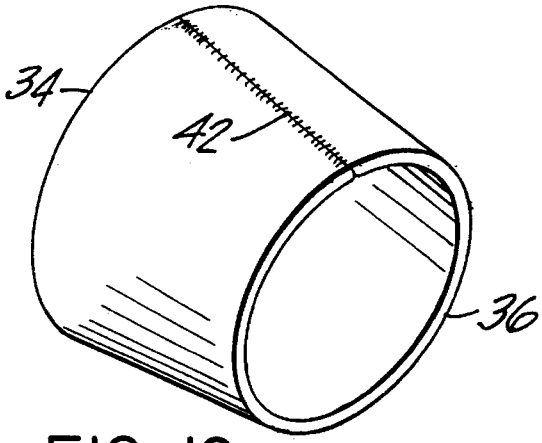
FIG. 10 is a perspective view of the band of FIG. 9 in a folded state with the end edges secured together to form a truncated, cone-like member having a tapered outer surface.

Referring to FIGS. 9 and 10, band 32 has a first edge 34 and a second edge 36 spaced-apart and parallel to first edge 34. The length of band 32 along first edge 34 is approximately 9 inches (22.86 cm) and the length of said band along second edge 36 is approximately 7.5 inches (19.05 cm). The spacing between edges 34 and 36 is approximately 3 inches (7.62 cm). The aforesaid configuration defines oppositely inclined end edges 38 and 40, respectively, which are joined upon rolling of band 32 and are sewn together by stitching 42. As is now apparent from FIG. 10, the perimeter of first edge 34 is greater than the perimeter of second edge 36 to provide an inward taper for band 32 from first edge 34 to second edge 36.

Referring now to FIGS. 1–5, band 32 is positioned to encircle intermediate zone 22 of sock 12 with the first edge 34 of said band positioned near heel zone 18. As such, it follows that the second edge 36 of band 12 is located near toe zone 20.

The first edge 34 of band 32 is preferably sewn to sock 12 by stitching 44 extending along the outer perimeter 28 of intermediate zone 22 of the sock. The other or second edge 36 of band 32 is left unattached to sock 12 to permit expansion of the band as hereinafter described. It will be appreciated that only one of the band edges 34 or 36 need be sewn to the sock to maintain the band in place. As such, while the longer band edge 34 is the preferred edge sewn to the sock, it is within the purview of the invention that second edge 36 alternatively may constitute the attached edge with first edge 34 left unattached.

The invention further provides that the perimeter of second edge 36 of band 32 is substantially less than the perimeter of the intermediate zone 22 of sock 12 adjacent to said second edge. Also, the taper of band 32 is at an angle sufficient to cause the intermediate zone 22 of sock 12 to be compressed along most of the length of band 32 from the first edge 34 to the second edge 36. The configuration is such that insertion of the wearer's foot into a properly sized sock 12, as shown in FIG. 3, will cause the band 32 to expand along the unattached portions thereof thereby giving a "wrapping" action of the band relative to the wearer's foot to provide support to the arch portion of the foot. Such wrapping action automatically results merely by inserting the foot into the sock to cause expansion of the band. The wearer does not have to wrap a separate bandage around the foot nor is the assistance of another person normally necessary.

Figure 5:
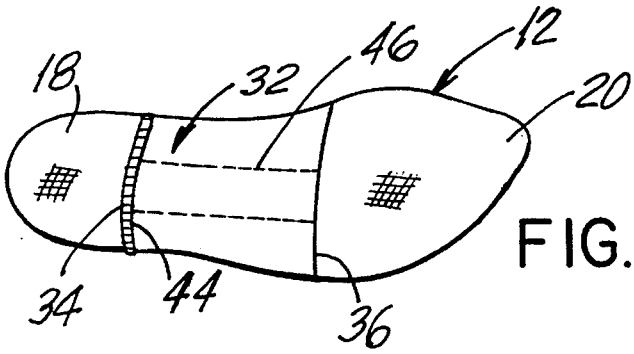
FIG. 5 is a view similar to FIG. 4 showing the elastic band further sewn to the lower surface of an intermediate zone of the sock.

To insure that band 32 does not get twisted out of position during insertion of the wearer's foot into sock 12, it may be desirable to also sew band 32 to the lower surface 26 of intermediate zone 22 of the sock. This is shown in FIG. 5 wherein the attachment is by means of one or more stitch lines 46 extending between the first edge 34 of band 32 and the second edge 36. However, for most applications of use, stitching 46 will not be necessary.

Figure 8:
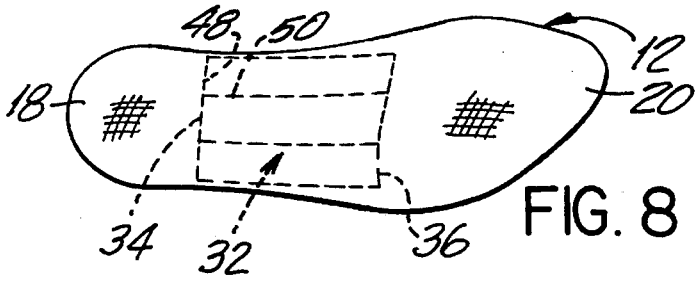
FIG. 8 is a bottom plan view, similar to that of FIG. 5, of the sock shown in FIG. 7 showing the elastic band further sewn to the lower surface of the intermediate zone of the sock.
Figure 7:
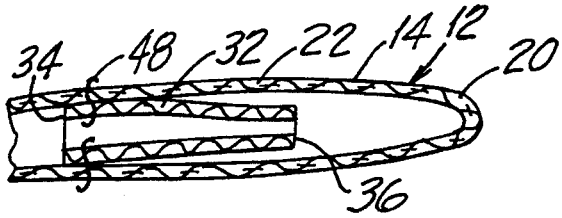
FIG. 7 is a sectional view taken along line 7—7 of FIG. 6.
Figure 6:
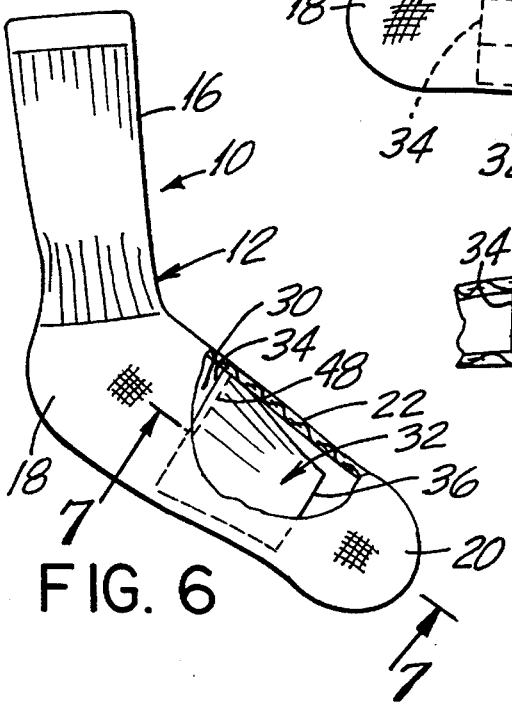
FIG. 6 is a view similar to FIG. 1, with a portion of the sock broken away, showing another embodiment of the invention wherein the band is sewn to the sock along an inner perimeter of the intermediate zone of the sock.

FIGS. 6–8 show another embodiment of the invention wherein the first edge 34 of band 32 is sewn to sock 12 by stitching 48 extending along the inner perimeter 30 of intermediate zone 22 of the sock. Accordingly, band 32 may be regarded as extending around the intermediate zone 22 of sock 12 wherein the word "around" is intended to mean either along the outer perimeter 28 or inner perimeter 30 of intermediate zone 22. Here, again, additional stitching 50 may be provided for securing band 32 to the lower surface of the intermediate zone of the sock, if necessary, as shown in FIG. 8. In other aspects, the advantages and features of this embodiment of the invention are the same as those applicable to the embodiment of FIGS. 1–5.

While preferred embodiments of the invention have been shown and described in detail, it will be apparent to those skilled in the art that various changes and modifications may be made without departing from the basic principles of the invention as embraced by the following claims.

What is claimed is:

1. In a sock having a foot portion and a leg portion, said foot portion having a heel zone, a toe zone and an intermediate zone between the heel zone and toe zone, and said intermediate zone having an upper surface, a lower surface, an outer perimeter and an inner perimeter, the improvement in an arch support for the foot of a person wearing said sock comprising:

an elastic band around the intermediate zone of said sock, said band having a first edge near the heel zone and a second edge near the toe zone of said sock;

the perimeter of the first edge of said band being greater than the perimeter of the second edge thereof to provide an inward taper for said band from said first edge to said second edge;

one of the first or second edges of said band being attached to the intermediate zone of said sock and the other one of said edges being unattached to said sock; and the perimeter of the unattached edge of said band being substantially less than the perimeter of the intermediate zone of said sock adjacent to said unattached edge;

whereby insertion of a wearer's foot for which said sock is sized in the sock will cause said elastic band to expand and provide support to the arch of the foot.

2. The sock arch support of claim 1, wherein:

the sole attachment between said elastic band and the intermediate zone of said sock being at the attached edge of said band.

3. The sock arch support of claim 1, wherein:

said elastic band is configured to cause the intermediate zone of said sock to be compressed along most of the length of said band.

4. The sock arch support of claim 1, wherein:

the attached edge of said band is sewn to said sock along an outer perimeter of the intermediate zone of said sock.

5. The sock arch support of claim 1, wherein:

the attached edge of said band is sewn to said sock along an inner perimeter of the intermediate zone of said sock.

6. The sock arch support of claim 1 wherein:

said band is further attached to the lower surface of the intermediate zone of said sock along at least one line extending between the attached edge and the unattached edge of said band.

7. In a sock having a foot portion and a leg portion, said foot portion having a heel zone, a toe zone and an intermediate zone between the heel zone and toe zone, and said intermediate zone having an upper surface, a lower surface, an outer perimeter and an inner perimeter, the improvement in an arch support for the foot of a person wearing said sock comprising:

an elastic band around the intermediate zone of said sock, said band having a first edge near the heel zone and a second edge near the toe zone of said sock;

the perimeter of the first edge of said band being greater than the perimeter of the second edge thereof to provide an inward taper for said band from said first edge to said second edge;

the first edge of said band being attached to the intermediate zone of said sock and the second edge thereof being unattached to said sock; and the perimeter of the second edge of said band being substantially less than the perimeter of the intermediate zone of said sock adjacent to said second edge;

whereby insertion of a wearer's foot for which said sock is sized in the sock will cause said elastic band to expand and provide support to the arch of the foot.

8. The sock arch support of claim 7, wherein:

the sole attachment between said elastic band and the intermediate zone of said sock being at the first edge of said band.

9. The sock arch support of claim 7, wherein:

said elastic band is configured to cause the intermediate zone of said sock to be compressed along most of the length of said band.

10. The sock arch support of claim 7, wherein:

the taper of said elastic band is at an angle sufficient to cause the intermediate zone of said sock to be compressed along most of the length of said band from said first edge to said second edge.

11. The sock arch support of claim 7, wherein:

the first edge of said band is sewn to said sock along an outer perimeter of the intermediate zone of said sock.

12. The sock arch support of claim 7, wherein:

said elastic band encircles the intermediate zone of said sock.

13. The sock arch support of claim 7, wherein:

the first edge of said band is sewn to said sock along an inner perimeter of the intermediate zone of said sock.

14. The sock arch support of claim 7, wherein:

said band is further attached to the lower surface of the intermediate zone of said sock along at least one line extending between the first edge and second edge of said band.

15. In a sock having a foot portion and a leg portion, said foot portion having a heel zone, a toe zone and an intermediate zone between the heel zone and toe zone, and said intermediate zone having an upper surface, a lower surface, an outer perimeter and an inner perimeter, the improvement in an arch support for the foot of a person wearing said sock comprising:

an elastic band encircling the intermediate zone of said sock, said band having a first edge near the heel zone and a second edge near the toe zone of said sock;

the perimeter of the first edge of said band being greater than the perimeter of the second edge thereof to provide an inward taper for said band from said first edge to said second edge;

the first edge of said band being attached to the intermediate zone of said sock and the second edge thereof being unattached to said sock;

the perimeter of the second edge of said band being substantially less than the perimeter of the intermediate zone of said sock adjacent to said second edge; and the taper of said elastic band being at an angle sufficient to cause the intermediate zone of said sock to be compressed along most of the length of said band from said first edge to said second edge;

whereby insertion of a wearer's foot for which said sock is sized in the sock will cause said elastic band to expand and provide support to the arch of the foot.

16. The sock arch support of claim 15, wherein:

the first edge of said band is sewn to said sock along an outer perimeter of the intermediate zone of said sock.

17. The sock arch support of claim 15, wherein:

the first edge of said band is sewn to said sock along an inner perimeter of the intermediate zone of said sock.

18. The sock arch support of claim 15, wherein:

said band is further attached to the lower surface of the intermediate zone of said sock along at least one line extending between the first edge and second edge of said band.

* * * * *